US012146375B1

(12) United States Patent
Chatelet et al.

(10) Patent No.: US 12,146,375 B1
(45) Date of Patent: Nov. 19, 2024

(54) MONITORING CASING ANNULUS

(71) Applicant: Schlumberger Technology Corporation, Sugar Land, TX (US)

(72) Inventors: Vincent Chatelet, Clamart (FR); Jean-Christophe Auchere, Clamart (FR); Dominique Sabina, Clamart (FR); Christophe Michaud, Clamart (FR); Fabio Cecconi, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/715,122

(22) PCT Filed: Apr. 28, 2023

(86) PCT No.: PCT/US2023/020313

§ 371 (c)(1),
(2) Date: May 31, 2024

(87) PCT Pub. No.: WO2023/212270

PCT Pub. Date: Nov. 2, 2023

Related U.S. Application Data

(60) Provisional application No. 63/363,719, filed on Apr. 28, 2022.

(51) Int. Cl.
*E21B 47/06* (2012.01)
*E21B 23/06* (2006.01)
(Continued)

(52) U.S. Cl.
CPC ..... *E21B 23/06* (2013.01); *E21B 29/02* (2013.01); *E21B 33/12* (2013.01); *E21B 47/06* (2013.01)

(58) Field of Classification Search
CPC ..... E21B 23/06; E21B 29/02; E21B 33/12; E21B 47/06
See application file for complete search history.

(56) References Cited

U.S. PATENT DOCUMENTS 3,500,911 A * 3/1970 Farley ..... E21B 33/124 166/387
4,069,866 A * 1/1978 Upchurch ..... E21B 33/124 166/147

(Continued)

FOREIGN PATENT DOCUMENTS

WO 2022081017 A1 4/2022

OTHER PUBLICATIONS

Search Report and Written Opinion of International Patent Application No. PCT/US2023/020313 dated Aug. 10, 2023, 12 pages.

*Primary Examiner* — Steven A MacDonald
(74) *Attorney, Agent, or Firm* — Jeffrey D. Frantz

(57) ABSTRACT

An apparatus with a straddle packer for use within a wellbore. The straddle packer can include a tubular body comprising a first bore and a second bore and a first sealing element configured to seal against an inner surface of a casing installed within the wellbore. A second sealing element configured to seal against the inner surface of the casing, and the second bore can be located between the first sealing element and the second sealing element. An obstruction disposed in association with the tubular body, wherein the obstruction is movable between a first position in which the obstruction opens the second bore and a second position in which the obstruction closes the second bore.

20 Claims, 7 Drawing Sheets

(51) Int. Cl.
*E21B 29/02* (2006.01)
*E21B 33/12* (2006.01)

(56) References Cited

U.S. PATENT DOCUMENTS

| | | | | |
|---|---|---|---|---|
| 4,962,815 | A | 10/1990 | Schultz | |
| 5,383,520 | A * | 1/1995 | Tucker | E21B 33/1243 166/186 |
| 5,799,733 | A * | 9/1998 | Ringgenberg | E21B 33/1243 166/147 |
| 5,803,186 | A * | 9/1998 | Berger | E21B 49/008 166/264 |
| 6,763,883 | B2 * | 7/2004 | Green | E21B 23/04 166/250.17 |
| 7,140,434 | B2 | 11/2006 | Chouzenoux et al. | |
| 2001/0027865 | A1 | 10/2001 | Wester | |
| 2007/0295504 | A1 * | 12/2007 | Patel | E21B 47/006 322/14 |
| 2008/0066535 | A1 * | 3/2008 | Vasques | E21B 49/081 73/152.17 |
| 2011/0088895 | A1 * | 4/2011 | Pop | E21B 44/00 166/254.2 |
| 2012/0061095 | A1 | 3/2012 | Capderou | |
| 2014/0246209 | A1 | 9/2014 | Themig | |
| 2014/0251601 | A1 * | 9/2014 | Wang | E21B 47/07 166/250.01 |
| 2019/0136659 | A1 * | 5/2019 | Ringgenberg | E21B 17/003 |

* cited by examiner

MONITORING CASING ANNULUS

This application is the National Stage Entry of International Application No. PCT/US2023/020313, filed Apr. 28, 2023, which claims the benefit of U.S. Provisional Application No. 63/363,719, entitled "MONITORING CASING ANNULUS," filed Apr. 28, 2022, the disclosure of which is hereby incorporated herein by reference.

BACKGROUND OF THE DISCLOSURE

Oil and gas wells are drilled into Earth's surface or ocean bed to recover natural deposits of reservoir fluid (e.g., oil and gas) trapped within reservoirs in subterranean geological formations. After a wellbore is drilled, a plurality of casing strings (e.g., casing A, casing B, casing C, etc.) may be installed concentrically within the wellbore to protect the sidewall of the wellbore, isolate different subterranean formations, and maintain control of the reservoir fluid and well pressure during various subsequent downhole operations. The casing strings may be secured within the wellbore by cement. After the well is completed, various intervention operations may be performed to stimulate or otherwise optimize well productivity. Thereafter, additional metal tubular strings may be inserted within the wellbore to facilitate delivery of treatment fluid downhole and produce (or transfer) the reservoir fluid to the wellsite surface.

The annular space between the production tubing and casing A is known as annulus A. Similarly, the annular space between casing A and casing B is known as annulus B, and the annular space between casing B and casing C is known as annulus C. Pressure and/or temperature within annulus B are reliable indicators of the condition of well barriers formed by the casing strings and, thus, well safety. Thus, pressure and/or temperature sensors are installed within annulus B during well construction to facilitate real-time pressure and/or temperature monitoring of annulus B during subsequent production operations. For example, various sensors (e.g., pressure and/or temperature sensors) and communication devices (e.g., wireless transmitters and/or receivers) may be installed on or otherwise attached to the outside of casing A before or while casing A is being installed within the wellbore. Communication devices operable to communicate with the annulus B sensors and surface equipment may be subsequently deployed downhole with the production tubing to facilitate communication between the annulus B sensors and the surface equipment and, thus, facilitate real-time monitoring of pressure, temperature, and/or other parameters of annulus B.

However, such pressure and/or temperature monitoring of annulus B cannot be performed in existing wells that do not include pressure and/or temperature sensors installed within annulus B, because annulus B is sealed and not accessible for direct pressure and/or temperature measurements. Lack of pressure and/or temperature monitoring within annulus B prevents a robust assessment of the condition of the well barriers formed by the casing strings.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
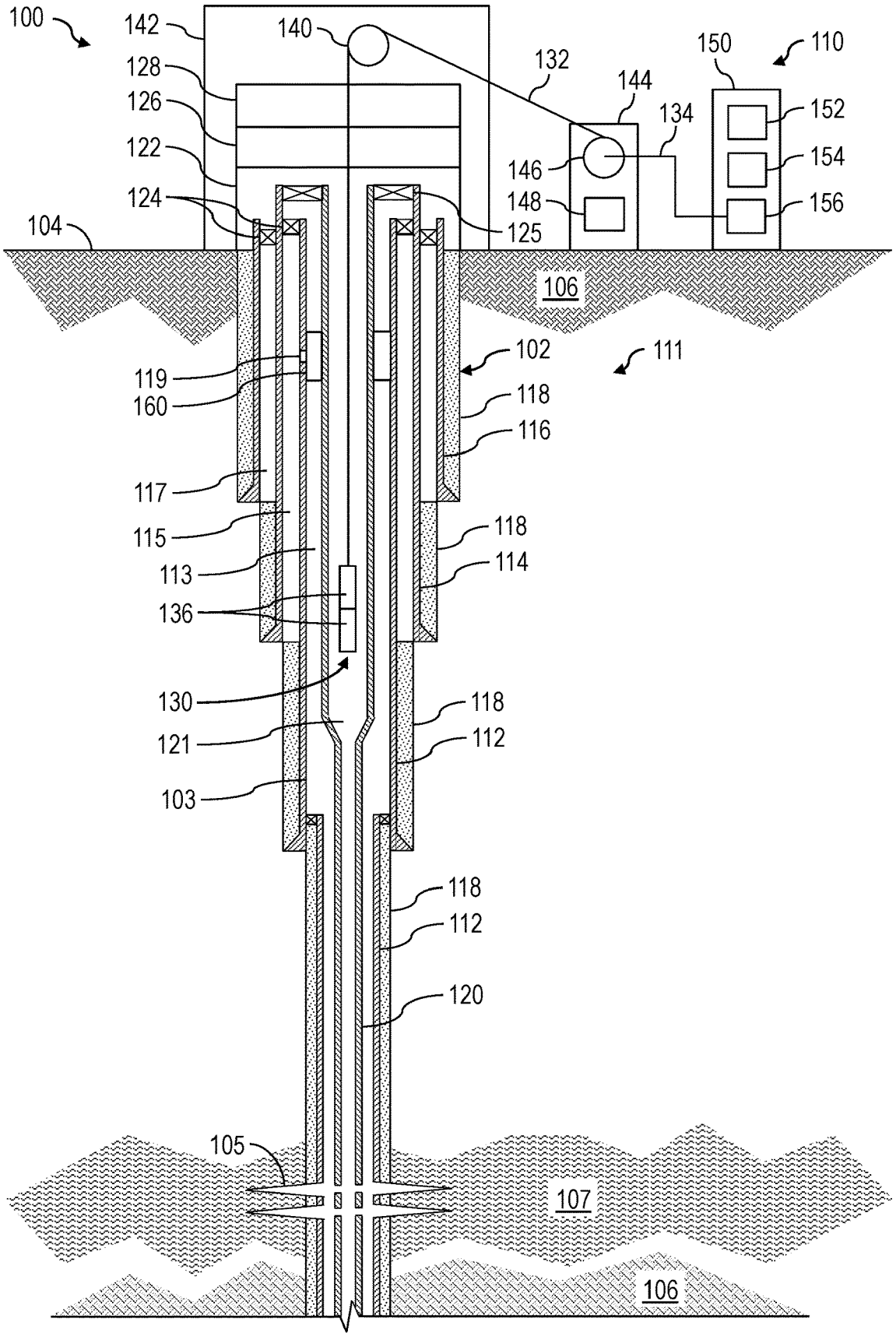
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Furthermore, terms, such as upper, upward, above, lower, downward, and/or below are utilized herein to indicate relative positions and/or directions between apparatuses, tools, components, parts, portions, members and/or other elements described herein, as shown in the corresponding figures. Such terms do not necessarily indicate relative positions and/or directions when actually implemented. Such terms, however, may indicate relative positions and/or directions with respect to a wellbore when an apparatus according to one or more aspects of the present disclosure is utilized or otherwise disposed within the wellbore. For example, the terms upper and upward may mean in the uphole direction or uphole from, and the terms lower and downward may mean in the downhole direction or downhole from.

FIG. 1 is a schematic view of at least a portion of an example implementation of a wellsite system 100 according to one or more aspects of the present disclosure, representing an example environment in which one or more aspects of the present disclosure may be implemented. The wellsite system 100 is depicted in relation to a wellbore 102 formed by rotary and/or directional drilling and extending from a wellsite surface 104 into a subterranean formation 106 comprising a subterranean reservoir 107 containing oil and/or gas. The wellsite system 100 includes surface equipment 110 located at the wellsite surface 104 and downhole equipment 111 installed or otherwise disposed within the wellbore 102. The wellsite system 100 may be utilized to facilitate the recovery of reservoir fluid containing the oil and/or gas from the subterranean reservoir 107 via the wellbore 102. It is noted that although the wellsite system 100 is depicted as an onshore implementation, it is to be understood that the aspects described below are also generally applicable or readily adaptable to offshore implementations.

At least a portion of the wellbore 102 may be a cased wellbore 102 comprising a plurality of casings (or casing strings) installed concentrically within the wellbore 102 and secured by cement. For example, the casings may include an inner casing 112 comprising an upper portion (or upper casing string) and a lower portion (or lower casing string) collectively defining an internal space 103 of the wellbore 102. The casings may further comprise an intermediate casing 114 surrounding a portion of the inner casing 112. The casings may also comprise an outer casing 116 surrounding a portion of the intermediate casing 114. Each casing may be secured within the wellbore 102 by a corresponding layer of cement 118. A production tubing (or production tubing string) 120 may be installed within the internal space 103 of the wellbore 102 to facilitate the production of the reservoir fluid from the subterranean reservoir 107 to the surface equipment 110 at the wellsite surface 104. The production tubing 120 may define an internal space 121 through which the reservoir fluid may be transferred from the subterranean reservoir 107 to the wellsite surface 104. The inner casing 112 and the production tubing 120 may define an inner annular space 113 therebetween, the intermediate casing 114 and the inner casing 112 may define an intermediate annular space 115 therebetween, and the outer casing 116 and the intermediate casing 114 may define an outer annular space 117 therebetween. The casings 112, 114, 116 may be referred to in the oil and gas industry as casing A, casing B, and casing C, respectively, and the annular spaces 113, 115, 117 may be referred to in the oil and gas industry as annulus A, annulus B, and annulus C, respectively.

The surface equipment 110 may comprise a surface termination of the wellbore 102, known as a wellhead 122, comprising various spools, valves, and adapters that provide pressure control of the wellbore 102 and facilitate access to the internal space 103 of the wellbore 102, including the annular space 113 and the internal space 121 of the production tubing 120. The wellhead 122 may support each casing 112, 114, 116 in a predetermined position within the wellbore 102 during well construction operations. For example, each casing 112, 114, 116 may be connected to the wellhead 122 via a corresponding casing hanger 124, each maintaining a corresponding casing 112, 114, 116 in the predetermined position and fluidly isolating (or scaling) a corresponding annular space 113, 115 from the internal space 103 of the wellbore 102 and other portions of the wellhead 122. The wellhead 122 may support the production tubing 120 suspended within the internal space 103 of the wellbore 102 via a production tubing hanger 125.

A downhole intervention and/or sensor assembly, referred to as a tool string 130, may be conveyed within the internal space 103 of the wellbore 102 when the production tubing 120 is not installed within the internal space 103 or within the internal space 121 of the production tubing 120 when the production tubing 120 is installed within the internal space 103 of the wellbore 102. The tool string 130 may be conveyed within the wellbore 102 via a conveyance line 132 operably coupled with one or more pieces of the surface equipment 110. For example, the conveyance line 132 may be operably connected with a conveyance device 140 operable to apply an adjustable downward- and/or upward-directed force to the tool string 130 via the conveyance line 132 to convey the tool string 130 within the wellbore 102. The conveyance line 132 may be or comprise coiled tubing, a cable, a wireline, a slickline, a multiline, or an e-line, among other examples also within the scope of the present disclosure. The conveyance device 140 may be, comprise, or form at least a portion of a sheave or pulley, a winch, a drawworks, an injector head, and/or another device coupled to the tool string 130 via the conveyance line 132. The conveyance device 140 may be supported above the wellbore 102 via a mast, a derrick, a crane, and/or other support structure, which are collectively depicted in FIG. 1 by structure 142. The surface equipment 110 may further comprise a reel or drum 146 configured to store thereon a wound length of the conveyance line 132, which may be selectively wound and unwound by the conveyance device 140 to selectively convey the tool string 110 into, along, and out of the wellbore 102. Instead of or in addition to the conveyance device 140, the surface equipment 110 may comprise a winch conveyance device 144 comprising or operably connected with the drum 146. The drum 146 may be rotated by a rotary actuator 148 (e.g., an electric motor) to selectively unwind and wind the conveyance line 120 to apply an adjustable tensile force to the tool string 130 and thereby selectively convey the tool string 130 into, along, and out of the wellbore 102.

The conveyance line 132 may comprise tubing, support wires, and/or cables configured to support the weight of the downhole tool string 130. The conveyance line 132 may also comprise one or more insulated electrical and/or optical conductors 134 operable to transmit electrical energy (i.e., electrical power) and electrical and/or optical signals (e.g., sensor data, control data, etc.) between the tool string 130 and one or more components of the surface equipment 110, such as a power and control system 150. The conveyance line 132 may comprise and/or be operable in conjunction with a means for communication between the tool string 130, the conveyance device 140, the winch conveyance device 144, and/or one or more other portions of the surface equipment 110, including the power and control system 150.

The wellbore 102 may be capped by a plurality (e.g., a stack) of fluid control devices 126, such as fluid control valves, spools, and fittings (e.g., a Christmas tree) individually and/or collectively operable to direct and control the flow of fluid out of the wellbore 102. The fluid control devices 126 may also or instead comprise a blowout preventer (BOP) stack operable to prevent the flow of fluid out of the wellbore 102. The fluid control devices 132 may be mounted on top of the wellhead 122.

The surface equipment 140 may further comprise a sealing and alignment assembly 128 mounted on the fluid control devices 126 and operable to seal the conveyance line 132 during deployment, conveyance, intervention, and other wellsite operations. The sealing and alignment assembly 128 may comprise a lock chamber (e.g., a lubricator, an airlock, a riser, etc.) mounted on the fluid control devices 126, a stuffing box operable to seal around the conveyance line 132 at the top of the lock chamber, and return pulleys operable to guide the conveyance line 132 between the stuffing box and the drum 146, although such details are not shown in FIG. 1. The stuffing box may be operable to seal around an outer surface of the conveyance line 132, such as via annular packings applied around the surface of the conveyance line 132 and/or by injecting a fluid between the outer surfaces of the conveyance line 132 and an inner wall of the stuffing box. The tool string 130 may be deployed into or retrieved from the wellbore 102 via the conveyance device 140 and/or the winch conveyance device 144 through the wellhead 122, the fluid control devices 126, and/or the sealing and alignment assembly 128.

The power and control system 150 (e.g., a control center) may be utilized to monitor and control various portions of the wellsite system 100. The power and control system 150 may be located at the wellsite surface 104 or on a structure located at the wellsite surface 104. However, the power and control system 150 may instead be located at a location remote from the wellsite surface 104. The power and control system 150 may include a source of electrical power 152, a control workstation 154 (i.e., a human machine interface (HMI)), and a surface controller 156 (e.g., a processing device or computer). The surface controller 156 may be communicatively connected with various equipment of the wellsite system 100, such as may permit the surface controller 156 to monitor operations of one or more portions of the wellsite system 100 and/or to provide control of one or more portions of the wellsite system 100, including the tool string 130, the conveyance device 140, and/or the winch conveyance device 144. The control workstation 154 may be communicatively connected with the surface controller 156 and may include input devices for receiving the control data from human wellsite personnel and output devices for displaying sensor data and other information to the human wellsite personnel. The surface controller 156 may be operable to receive and process sensor data or information from the tool string 130 and/or control data (i.e., control commands) entered to the surface controller 156 by the human wellsite personnel via the control workstation 154. The surface controller 156 may store executable computer programs and/or instructions and may be operable to implement or otherwise cause one or more aspects of methods, processes, and operations described herein based on the executable computer programs, the received sensor data, and the received control data.

The tool string 130 may be conveyed within the wellbore 102 to perform various downhole sampling, testing, intervention, and other downhole operations. The tool string 130 may further comprise one or more downhole tools 136 (e.g., devices, modules, etc.) operable to perform such downhole operations. The downhole tools 136 of the tool string 130 may each be or comprise an acoustic tool, a cable head, a casing collar locator (CCL), a cutting tool, a density tool, a depth correlation tool, a directional tool, an electrical power module, an electromagnetic (EM) tool, a formation testing tool, a fluid sampling tool, a gamma ray (GR) tool, a gravity tool, a formation logging tool, a hydraulic power module, a magnetic resonance tool, a formation measurement tool, a jarring tool, a mechanical interface tool, a monitoring tool, a neutron tool, a nuclear tool, a packer, a photoelectric factor tool, a plug, a plug setting tool, a porosity tool, a power module, a ram, a reservoir characterization tool, a resistivity tool, a seismic tool, a straddle packer, a stroker tool, a surveying tool, and/or a telemetry tool, among other examples also within the scope of the present disclosure. The downhole tools 136 of the tool string 130 (or another tool string, not shown) may comprise a perforating tool operable to form perforations 105 through the casing 112, the cement 118, and the formation 106 comprising the subterranean reservoir 107 to facilitate flow of the reservoir fluid into the wellbore 102.

The present disclosure is further directed to a downhole sensor system 160 for measuring properties of or within the intermediate annular space (or annulus B) 115. The sensor system 160 may be installed in the inner annular space 113 and in fluid communication with the intermediate annular space 115 via a hole (or opening) 119 in the inner casing 112 and extending between the inner annular space 113 and the intermediate annular space 115. The hole 119 may be formed by a downhole tool 136 (e.g., a hole puncher, a drill, etc.) conveyed downhole within the internal space 103 of the wellbore 102 as part of the tool string 130 before the production tubing 120 is installed. After the hole 119 is formed in the inner casing 112, at least a portion of the sensor system 160 may be installed in association with the hole 119 via the conveyance line 132 as part of the tool string 130 before the production tubing 120 is installed. The hole 119 may instead be formed after a first portion of the sensor system 160 is conveyed downhole via the conveyance line 132 and installed along the inner casing 112. For example, the hole 119 may be formed or otherwise facilitated by the first portion of the sensor system 160 installed along the inner casing 112 before the production tubing 120 is installed. Thereafter, a second portion of the sensor system 160 may be installed in association with the first portion of the sensor system 160 previously installed along the inner casing 112. For example, the second portion of the sensor system 160 may be installed in association with the first portion of the sensor system 160 via the production tubing 120 as the production tubing 120 is installed within the internal space 103 of the wellbore 102. The sensor system 160 may then be used to measure properties (e.g., pressure, temperature, etc.) of or within the intermediate annular space 115 and transmit sensor data indicative of such properties to the surface equipment 110 (e.g., the surface controller 156) via a downhole communication (or telemetry) means (e.g., wireless communication means and/or wired communication means). Wireless communication means may include an acoustic transmitter implemented as part of the sensor system 160 and operable to transmit acoustic signals via the production tubing 120 to a corresponding acoustic receiver located at the wellsite surface 104 and communicatively connected with the surface equipment. Wired communication means may include a communication conductor extending along the production tubing 120 between the sensor system 160 and the surface equipment 110.

Figure 2:
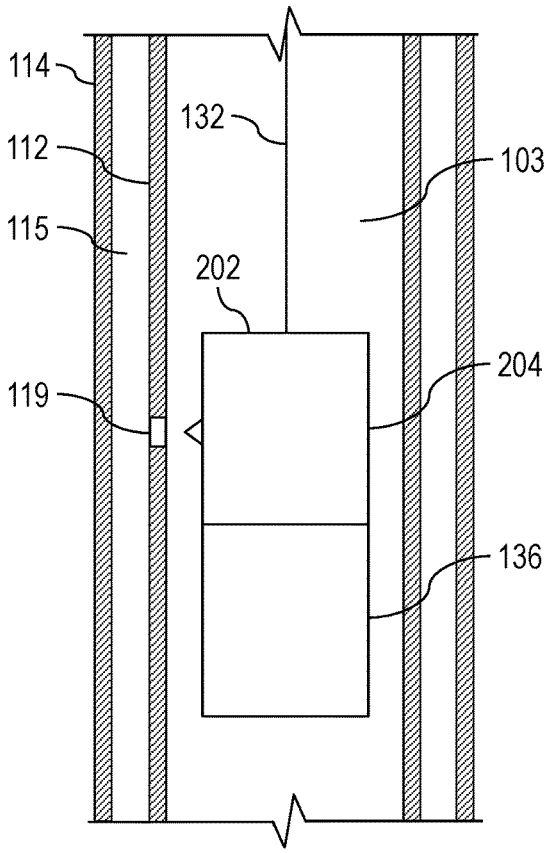
FIGS. 2-4 are schematic views of at least a portion of an example implementation of apparatus according to one or more aspects of the present disclosure in different stages of operation.

FIG. 2 is a schematic side view of at least a portion of an example implementation of a tool string 202 according to one or more aspects of the present disclosure. The tool string 200 may comprise one or more features and/or modes of operation of the tool string 130 shown in FIG. 1, including where indicated by like reference numerals. The following description refers to FIGS. 1 and 2, collectively.

The tool string 202 may comprise a downhole tool 204 (e.g., a hole puncher, a drill, a laser emitter, etc.) operable to form a hole (or opening) 119 through a wall of a tubular within which the tool string 202 is conveyed. For example, the tool string 202 may be conveyed downhole within the internal space 103 of the wellbore 102 and form the hole 119 in the inner casing 112 and extending into the intermediate annular space 115.

Figure 3:
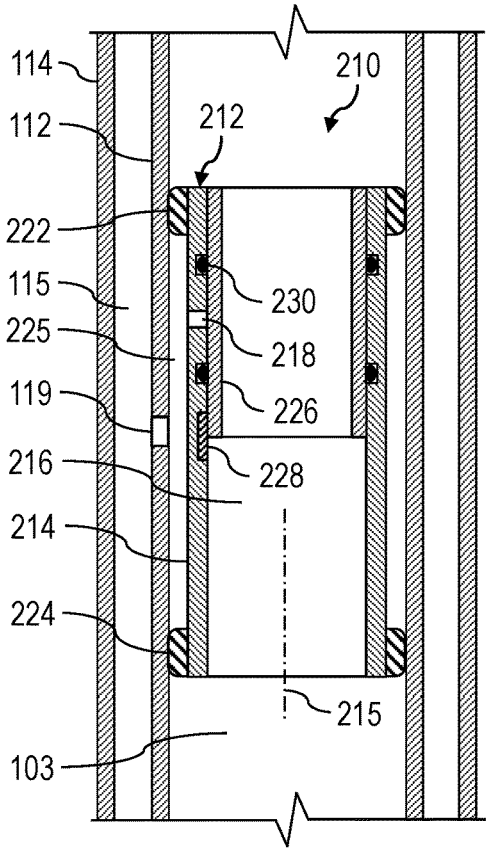
Figure 4:
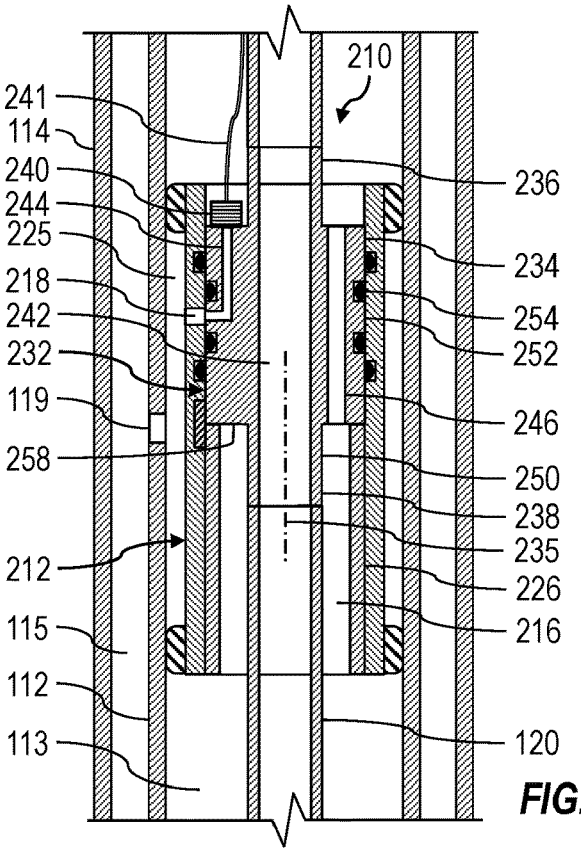

FIGS. 3 and 4 show schematic views of an example implementation of at least a portion of a downhole sensor system 210 for measuring properties of or within the intermediate annular space 115 in different stages of installation operations. The sensor system 210 may comprise one or more features and/or modes of operation of the sensor system 160 shown in FIG. 1. The following description refers to FIGS. 1-4, collectively.

After the hole 119 in the inner casing 112 and extending into the intermediate annular space 115 is formed by the downhole tool 204, a straddle packer 212 of the downhole sensor system 210 may be conveyed downhole and installed within the internal space 103 of the wellbore 102 in association with the hole 119. The straddle packer 212 may be conveyed downhole via the conveyance line 132 or other conveyance means. For example, the straddle packer 212 may be conveyed downhole as part of the tool string 202 and installed after the hole 119 is formed by the downhole tool 204. The straddle packer 212 may instead be conveyed downhole as part of another tool string and installed after the downhole tool 204 forms the hole 119 and the tool string 202 is retrieved to the wellsite surface 104.

The straddle packer 212 may comprise a packer body 214 comprising a first bore (or pathway) 216 and a second bore (or pathway) 218. The packer body 214 may comprise a tubular geometry, having an outer circumferential (or cylindrical) surface and an inner circumferential (or cylindrical) surface defining the first bore 216 extending along a central longitudinal axis 215 of the packer body 214. The second bore 218 may extend radially with respect to the central longitudinal axis 215 between the outer surface and the inner surface of the packer body 214. The straddle packer 212 may further comprise a first sealing element 222 carried by the packer body 214 and operable to expand in a radially outward direction to seal against an inner surface of the inner casing 112, and a second sealing element 224 carried by the packer body 214 and operable to expand in a radially outward direction to seal against the inner surface of the inner casing 112. The first sealing element 222 and the second sealing element 224 may be operable to isolate an interval of an annular space 225 defined between the inner surface of the inner casing 112 and the outer surface of the packer body 214 when the first sealing element 222 and the second sealing element 224 are sealed against the inner surface of the inner casing 112. The straddle packer 212 may also comprise an obstruction (e.g., an obstructing member, an obstruction system, etc.) selectively movable, reversible, or otherwise operable between a first position (shown in FIG. 3) in which the obstruction 226 closes (e.g., seals, covers, etc.) the second bore 218 to prevent fluid communication therethrough and a second position (shown in FIG. 4) in which the obstruction 226 opens the second bore 218 to permit fluid communication therethrough. The obstruction 226 may be or comprise, for example, a sleeve, a flapper, a check valve, or a pressure distribution element. The obstruction 226 may be movably disposed in association with the packer body 214. The obstruction 226 may be slidably movable along or otherwise with respect to the packer body 214 between the first position and the second position. The obstruction 226 may prevent fluid communication between the annular space interval 225 and the first bore 216 when the obstruction 226 is in the first position, and the obstruction 226 may permit fluid communication between the annular space interval 225 and the first bore 216 when the obstruction 226 is in the second position. The straddle packer 212 may further comprise a biasing means 228 (e.g., a pressure chamber, a spring, etc.) operable to urge the obstruction 226 toward the first position. The obstruction 226 may be slidably movable along the inner surface of the packer body 214.

During installation operations of the straddle packer 212, the straddle packer 212 may be conveyed within the inner casing 112 until the hole 119 is located between the first sealing element 222 and the second sealing element 224. The first sealing element 222 and the second sealing element 224 may then be set against the inner casing 112 such that the first sealing element 222 and the second sealing element 224 are located on opposing sides of the hole 119. The straddle packer 212 may further comprise one or more fluid seals 230 between the packer body 214 and the obstruction 226 to prevent or inhibit fluid communication therebetween.

After the straddle packer 212 is installed in association with the hole 119 and the tool string used for installing the straddle packer 212 is retrieved to the wellsite surface 104, a sensor sub 232 of the downhole sensor system 210 may be conveyed downhole within the internal space 103 of the wellbore 102 and installed in association with the straddle packer 212. The sensor sub 232 may be conveyed downhole via or as part of the production tubing 120 installed within the internal space 103 of the wellbore 102 for producing the reservoir fluid containing the oil and/or gas from the subterranean reservoir 107.

The sensor sub 232 may therefore be configured to engage the straddle packer 212 and for connection within the production tubing 120 or another downhole pipe string. For example, the sensor sub 232 may comprise a sub body 234 comprising a first connector 236 (e.g., a male or female threaded coupler) configured for connection with a first (e.g., upper) portion of the production tubing 120 and a second connector 238 (e.g., a male or female threaded coupler) configured for connection with a second (e.g., lower) portion of the production tubing 120. The sensor sub 232 may further comprise a sensor 240 connected to or otherwise carried by the sub body 234. The sensor 240 may be operable to output sensor data indicative of properties within the inner annular space 115. The sensor 240 may be or comprise a pressure sensor operable to output pressure data indicative of pressure within the inner annular space 115. The sensor 240 may also or instead be or comprise a temperature sensor operable to output temperature data indicative of temperature within the inner annular space 115. The sensor data output by the sensor 240 may be transmitted to the surface equipment 110 via a communication conductor 241 (e.g., a cable) extending along the production tubing 120 between the sensor 240 and the surface equipment 110.

The sub body 234 may further comprise a first bore (or pathway) 242 extending between the first connector 234 and the second connector 236, and configured to fluidly connect the first portion of the production tubing 120 and the second portion of the production tubing 120 to permit the reservoir fluid to flow through the sub body 234. The sub body 234 may comprise a tubular geometry, having an outer circumferential (or cylindrical) surface and an inner circumferential (or cylindrical) surface defining the first bore 242 extending along a central longitudinal axis 235 of the sub body 234. The sub body 234 may also comprise a second bore (or pathway) 244 extending between the outer surface of the sub body 234 and the sensor 240. The sub body 234 may further comprise an upper surface, a lower surface, and one or more third bores 246 extending between the upper surface and the lower surface, wherein the upper surface and the lower surface are on opposing sides of the outer surface of the sub body 234. The third bores 246 may be open to the inner annular space 113 thereby fluidly connecting the inner annular space 113 on opposing sides of the sensor system 210. The sub body 234 may comprise a smaller diameter section 250 comprising or containing the first connector 236, the second connector 238, and the first bore 242, and a larger diameter section 252 comprising or containing the outer surface, the second bore 244, and the third bores 246. The third bores 246 may be distributed circumferentially around the smaller diameter section 250 and the first bore 242.

The sensor sub 232 may be installed (or inserted) within or otherwise in association with the straddle packer 212 to assemble or otherwise form the sensor assembly 210. For example, the inner surface (or the bore 216) of the packer body 214 may be configured to accommodate the sensor sub 232 such that the outer surface of the sub body 234 is disposed against the inner surface of the packer body 214 and the bore 218 of the straddle packer 212 and the bore 244 of the sensor sub 232 are operatively connected (e.g., fluidly connected, in fluid communication, etc.). The sensor sub 232 may therefore comprise one or more fluid seals 254 along or carried by the outer surface of the sub body 234 to prevent or inhibit fluid communication between the inner surface of the packer body 214 and the outer surface of the sub body 234. Furthermore, the sensor sub 232 may be slidably movable within the straddle packer 212 such that when the sensor sub 232 is slidably moved within the straddle packer 212, the sub body 234 contacts the obstruction 226 and moves the obstruction 226 from the first position to the second position. For example, the sub body 234 may comprise a shoulder 258 facing downward and extending in a radially outward direction. The shoulder 258 may be configured to contact the obstruction 226 and move the obstruction 226 from the first position to the second position when the sensor sub 232 is slidably moved within the straddle packer 212.

When the sensor sub 232 is installed (or inserted) within or otherwise in association with the straddle packer 212 to assemble or otherwise form the sensor assembly 210, the sensor 240 may be operatively connected (e.g., fluidly connected, in fluid communication, etc.) with inner annular space 115 via the bores 218, 244, the interval of annular space 225, and the hole 119 in the inner casing 112. Accordingly, the sensor 240 may be in contact with or otherwise exposed to the fluid within the inner annular space 115 and, thus, operable to measure properties (e.g., temperature, pressure, etc.) of or within the inner annular space 115.

As described above with reference to FIGS. 2-4, a tool string 202 comprising a downhole tool 204 may be conveyed downhole within the internal space 103 of the wellbore 102 and form the hole 119 in the inner casing 112 and extending into the intermediate annular space 115. Such hole 119 may be formed before the downhole sensor system 210 is installed downhole.

Figure 5:
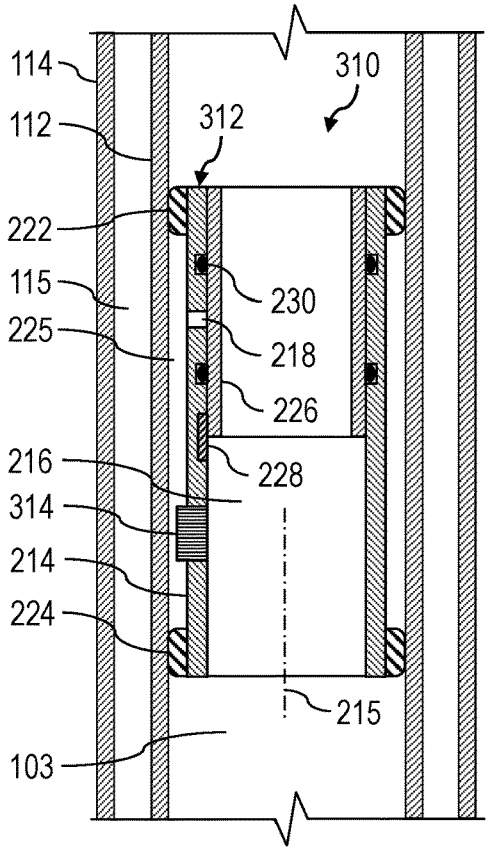
FIGS. 5-7 are schematic views of at least a portion of an example implementation of apparatus according to one or more aspects of the present disclosure in different stages of operation.
Figure 6:
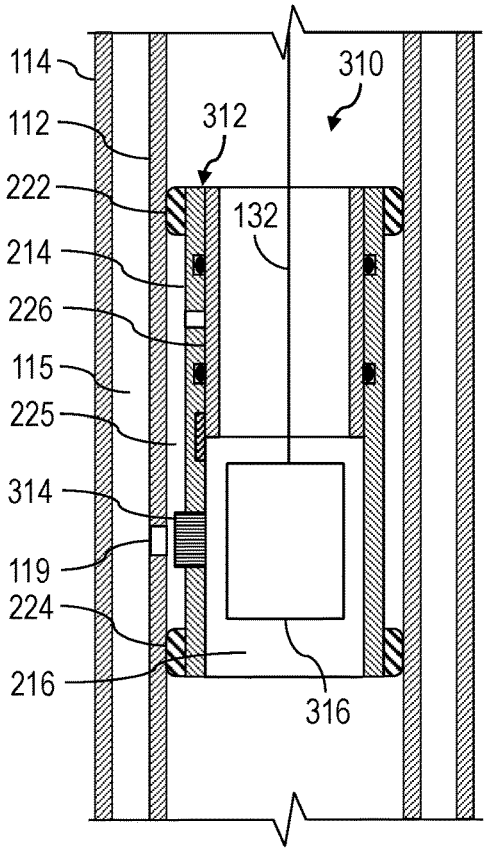
Figure 7:
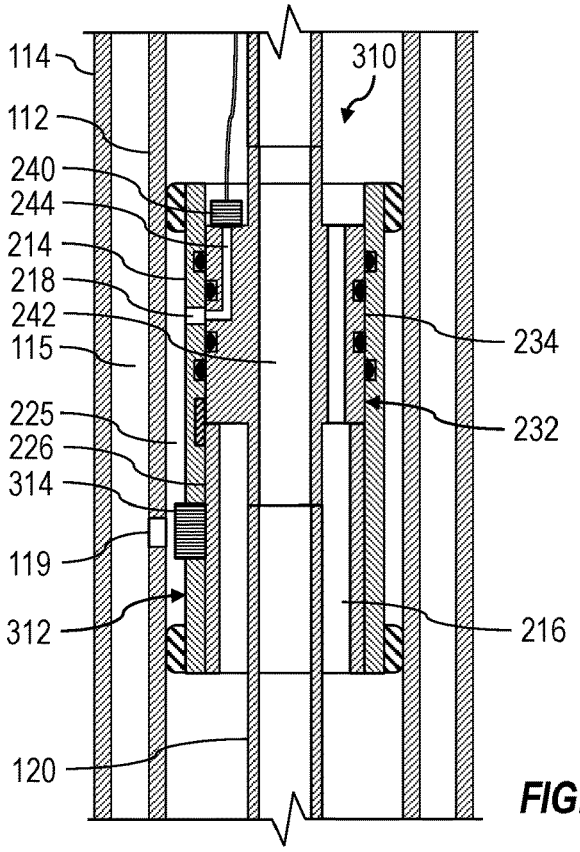

FIGS. 5-7 show schematic views of an example implementation of at least a portion of a downhole sensor system 310 for measuring properties of or within the intermediate annular space 115 in different stages of installation operations. The sensor system 310 may comprise one or more features and/or modes of operation of the sensor system 210 shown in FIGS. 3 and 4, including where indicated by the same reference numerals. However, the downhole sensor system 310 may be used to form or otherwise facilitate the hole 119 within the inner casing 112 while installing the downhole sensor system 310 downhole. The following description refers to FIGS. 1 and 5-7, collectively.

The sensor system 310 may comprise various features described above in association with the sensor system 210 shown in FIGS. 3 and 4 and indicated by the same reference numerals in FIGS. 5-7. As shown in FIG. 5, the sensor system 310 may further comprise a straddle packer 312 having a hole making device (or a hole maker) 314 located between the first sealing element 222 and the second sealing element 224 and carried by the packer body 214. The hole making device 314 may be operable to form the hole 119 through the inner casing 119 (or a wall of the inner casing 119) when the saddle packer 312 is disposed at a predetermined location within the internal space 103 of the wellbore 102 and set against the inner casing 112 such that the first sealing element 222 and the second sealing element 224 seal against the inner surface of the inner casing 112. As shown in FIG. 6, the hole making device 314 may then be operated to cause the hole making device 314 to form the hole 119. The hole making device 314 may be operated or caused to be operated by the tool string used to install the straddle packer 312 after the straddle packer 312 is set against the inner casing 112. The hole making device 314 may instead be operated or caused to be operated by a downhole tool 316 conveyed downhole within the first bore 216 of the straddle packer 312 adjacent the hole making device 314 after the straddle packer 312 is set against the inner casing 112. After the hole making device 314 forms the hole 119, the downhole tool 316 may be retrieved to the wellsite surface 104. Thereafter and as indicated in FIG. 7, the sensor sub 232 may be installed (or inserted) within or otherwise in association with the straddle packer 312 to assemble or otherwise form the sensor assembly 310. Similarly as described above with respect to sensor assembly 210, the sensor 240 of the sensor assembly 310 may be operatively connected (e.g., fluidly connected, in fluid communication, etc.) with inner annular space 115 via the bores 218, 244, the interval of annular space 225, and the hole 119 in the inner casing 112 and, thus, operable to measure properties (e.g., temperature, pressure, etc.) of or within the inner annular space 115.

Figure 8:
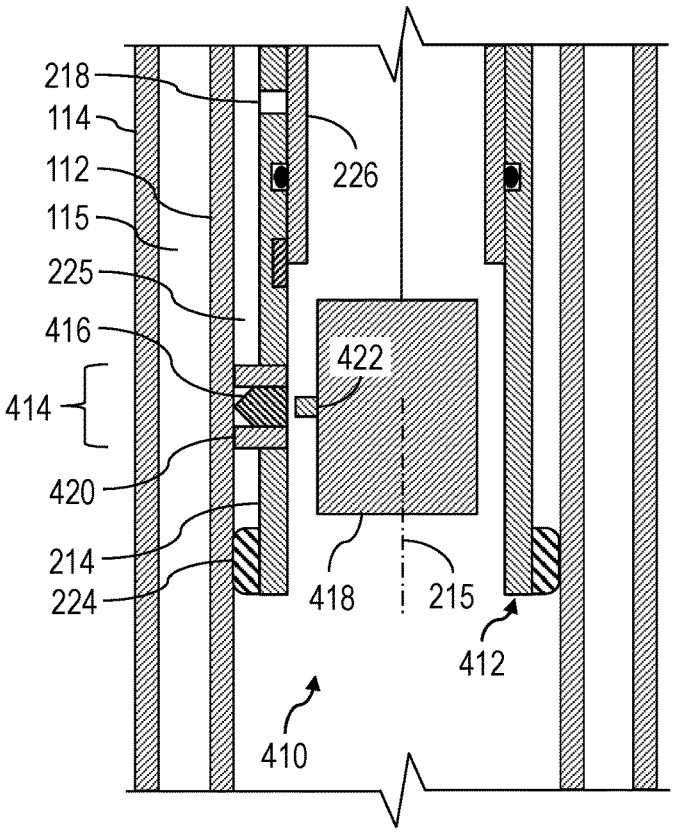
FIGS. 8 and 9 are schematic views of at least a portion of an example implementation of apparatus according to one or more aspects of the present disclosure in different stages of operation.
Figure 9:
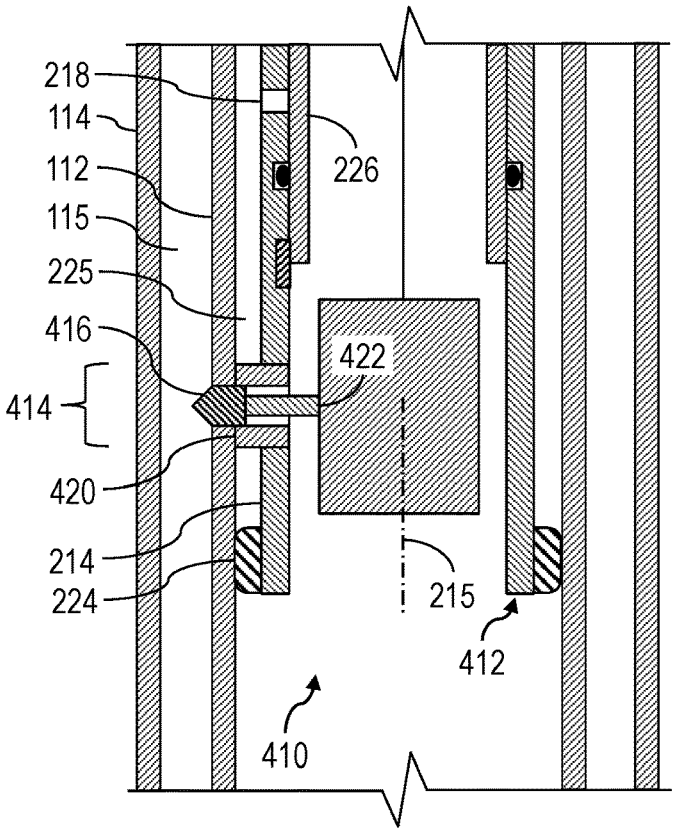

FIGS. 8 and 9 show schematic views of an example implementation of a portion of a downhole sensor system 410 for measuring properties of or within the intermediate annular space 115 in different stages of installation operations. The sensor system 410 may comprise one or more features and/or modes of operation of the sensor system 310 shown in FIGS. 5-7, including where indicated by the same reference numerals. The sensor system 410 may also comprise an example implementation of the hole making device 314 shown in FIGS. 5-7 and indicated in FIGS. 8 and 9 by reference numeral 414. The following description refers to FIGS. 1, 8, and 9, collectively.

As shown in FIG. 8, the sensor system 410 may comprise a straddle packer 412 comprising the hole making device 414 having a pin 416 configured to be moved by a downhole actuating tool (or actuator) 418 through the inner casing 112 (or the wall of the inner casing 112) to form the hole 119 through the inner casing 112. The pin 416 may be located between the first sealing element 222 and the second sealing element 224 and carried by the packer body 214. The pin 416 may be disposed within a guide tube 420 configured to maintain the pin 416 in a predetermined orientation while permitting the pin 416 to move radially with respect to the longitudinal axis 215 of the packer body 214. The hole making device 414 may be located along the outer surface of the packer body 214 or be fluidly sealed against the packer body 214 to prevent or inhibit fluid leakage between the annular space interval 225 and the internal space 103 of the wellbore 102. As shown in FIG. 9, the actuating tool 418 may comprise an actuating member 422 selectively operable to move in a radially outward direction against the pin 416 to move the pin 418 against and through the inner casing 112 to form the hole 119.

Figure 10:
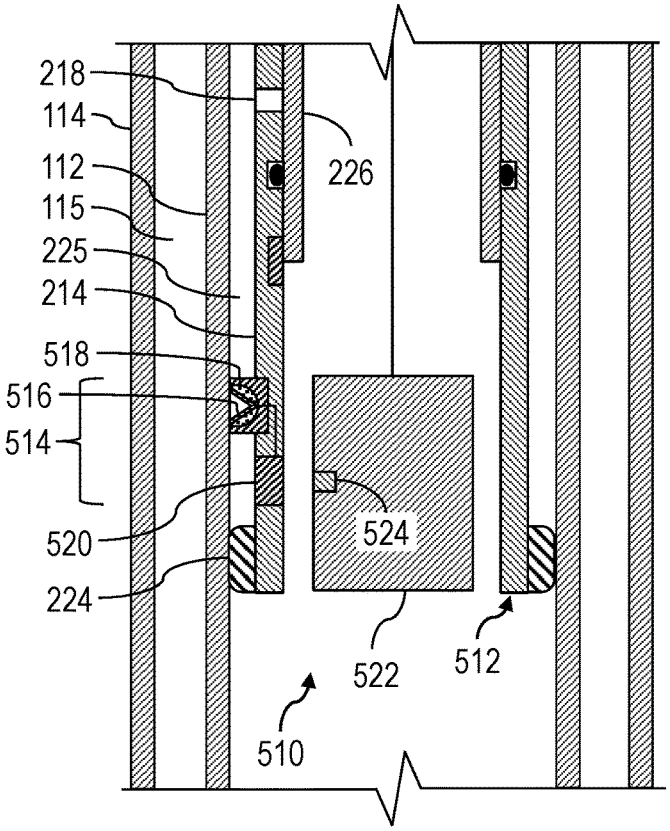
FIGS. 10 and 11 are schematic views of at least a portion of an example implementation of apparatus according to one or more aspects of the present disclosure in different stages of operation.
Figure 11:
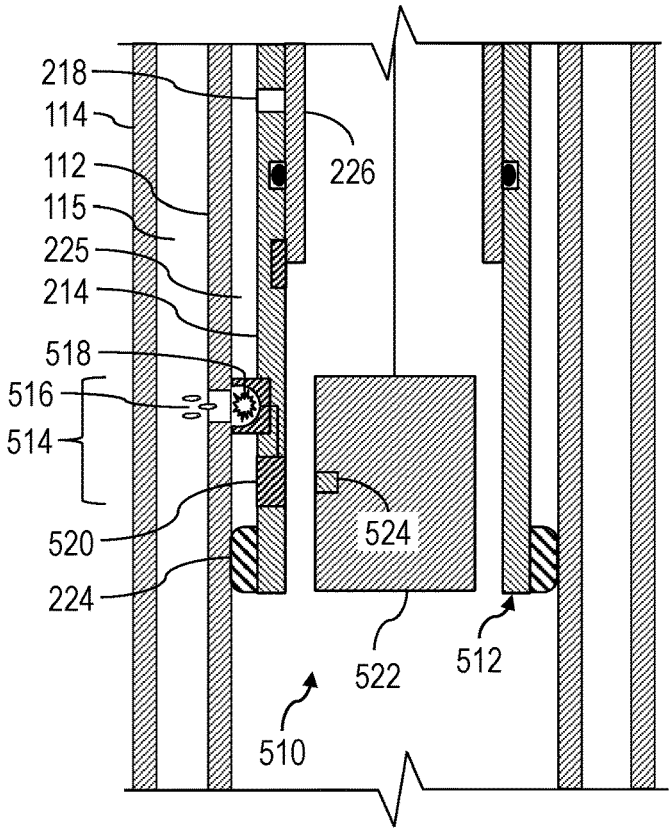

FIGS. 10 and 11 show schematic views of an example implementation of a portion of a downhole sensor system 510 for measuring properties of or within the intermediate annular space 115 in different stages of installation operations. The sensor system 510 may comprise one or more features and/or modes of operation of the sensor system 310 shown in FIGS. 5-7, including where indicated by the same reference numerals. The sensor system 510 may also comprise an example implementation of the hole making device 314 shown in FIGS. 5-7 and indicated in FIGS. 10 and 11 by numeral 514. The following description refers to FIGS. 1, 10, and 11, collectively.

As shown in FIG. 10, the sensor system 510 may comprise a straddle packer 512 having the hole making device 514 implemented as an explosive device (e.g., a shaped charge device). The hole making device 514 may comprise a projectile 516 and an explosive charge 518 operable to detonate to propel the projectile 516 toward the inner casing 112 to form the hole 119 through the inner casing 112 (or the wall of the inner casing 112). The hole making device 514 may further comprise a detonator switch 520 operable to detonate the explosive charge 518. The hole making device 514 may be located between the first sealing element 222 and the second sealing element 224 and carried by the packer body 214. The hole making device 514 may be located along the outer surface of the packer body 214 or be fluidly sealed against the packer body 214 to prevent or inhibit fluid leakage between the annular space interval 225 and the internal space 103 of the wellbore 102. A downhole activating tool (or activator) 522 may be conveyed downhole within the first bore 216 of the straddle packer 512 adjacent the hole making device 514 after the straddle packer 512 is set against the inner casing 112. The activating tool 522 may comprise a detonating device 524 operable to activate the detonator switch 520 to cause the detonator switch 520 to detonate the explosive charge 518. The detonating device 524 may be or comprise a transmitter operable to activate the detonator switch 520. The detonating device 524 may instead be or comprise the detonator switch 520 operable to detonate the explosive charge 518. As shown in FIG. 11, the activating tool 522 may cause the explosive charge 518 to detonate to cause the explosive charge 518 to propel the projectile 516 toward and through the inner casing 112 to form the hole 119.

Figure 12:
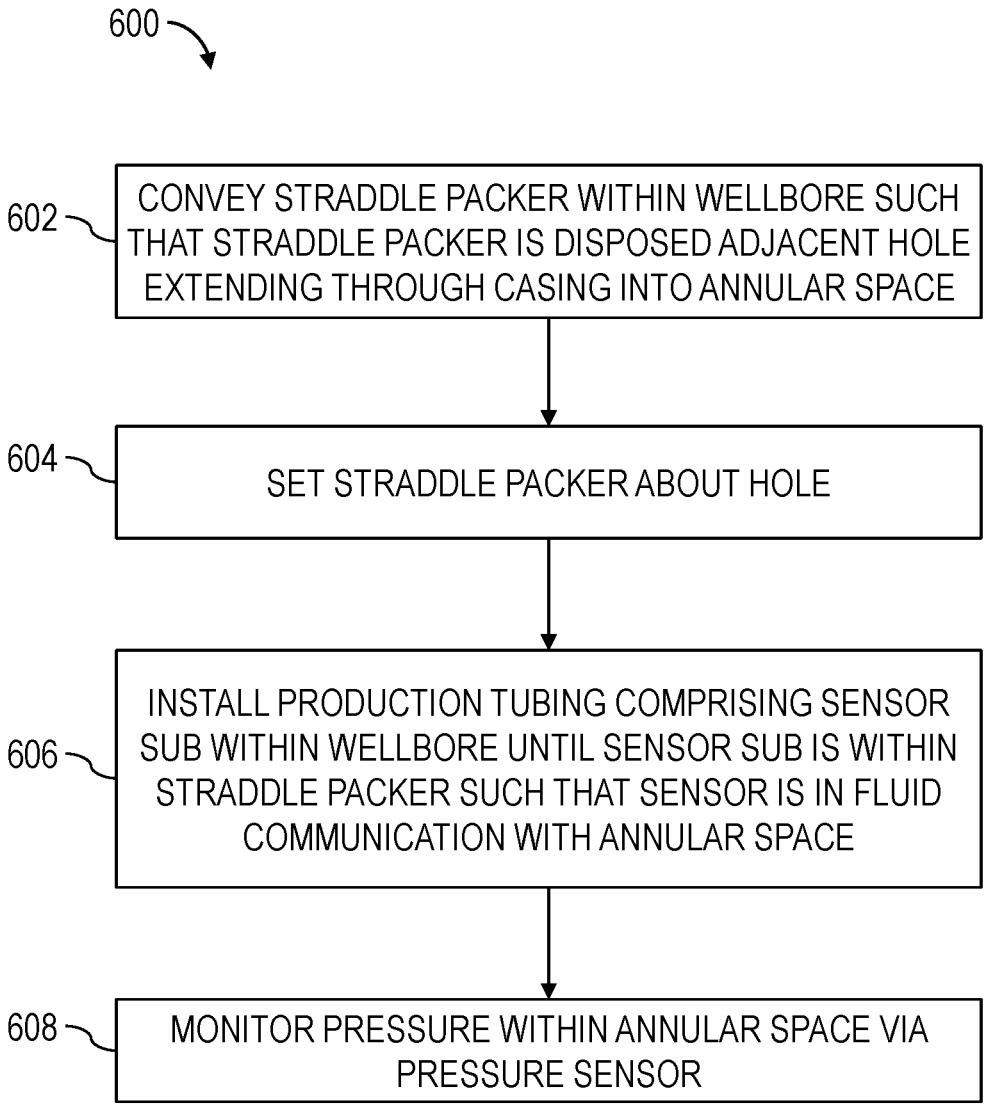
FIG. 12 is a flow-chart diagram of at least a portion of an example implementation of a method according to one or more aspects of the present disclosure.
Figure 13:
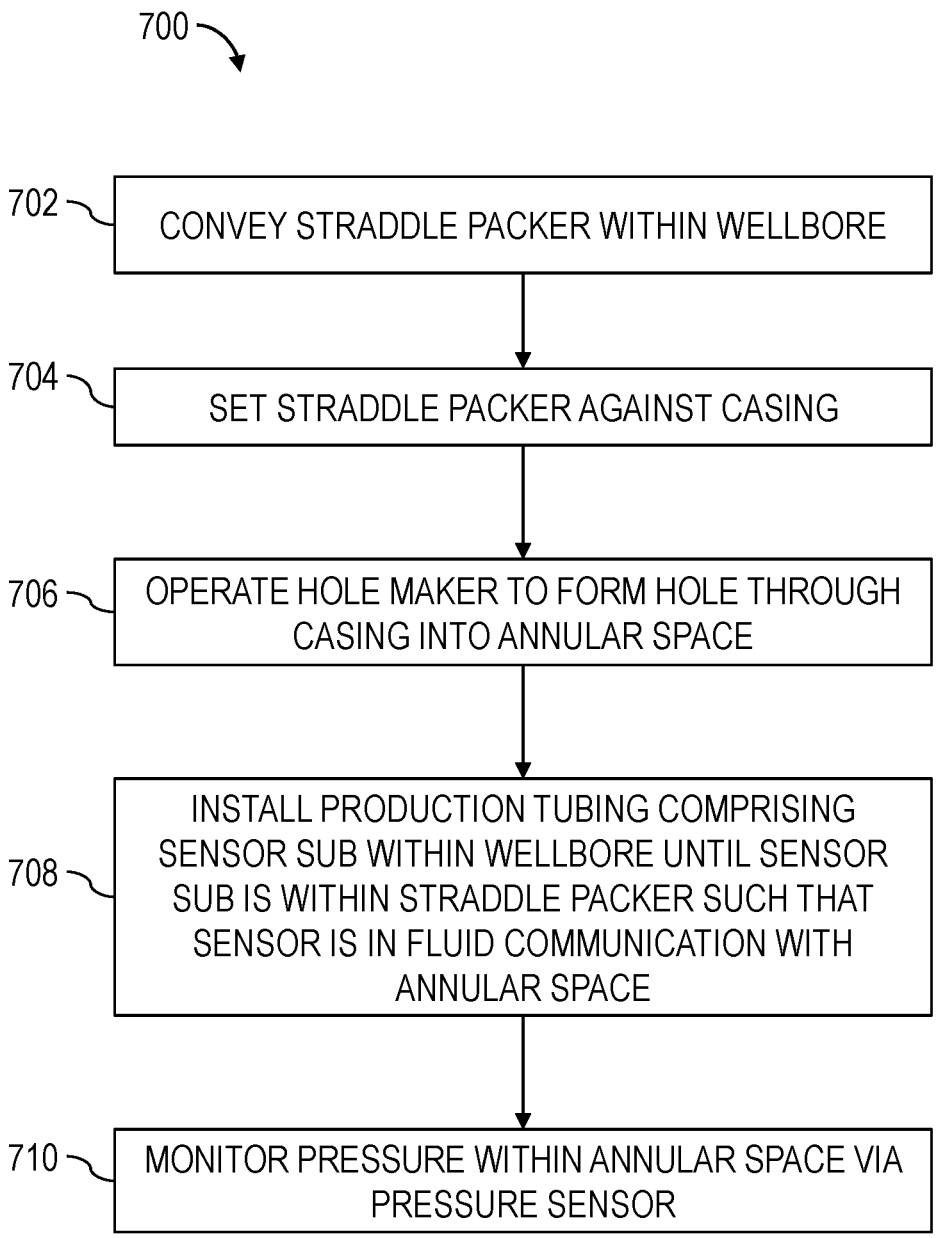
FIG. 13 is a flow-chart diagram of at least a portion of an example implementation of another method according to one or more aspects of the present disclosure.

FIGS. 12 and 13 are flow-chart diagrams of at least a portion of example methods 600, 700 (e.g., operations and/or processes) that can be performed to measure properties (e.g., temperature, pressure, etc.) of or within the inner annular space 115. The methods 600, 700 may be performed by utilizing (or otherwise in conjunction with) at least a portion of one or more implementations of one or more instances of the apparatus shown in one or more of FIGS. 1-11, and/or otherwise within the scope of the present disclosure. The methods 600, 700 may be caused to be performed, at least partially, by a processing device (e.g., the surface controller 156, etc.) executing computer program code according to one or more aspects of the present disclosure. The methods 600, 700 may also or instead be caused to be performed, at least partially, by a human user (e.g., human wellsite personnel) utilizing one or more instances of the apparatus shown in one or more of FIGS. 1-11, and/or otherwise within the scope of the present disclosure. Thus, the following description of example methods refer to apparatus shown in one or more of FIGS. 1-11. However, the methods may also be performed in conjunction with implementations of apparatus other than those depicted in FIGS. 1-11 that are also within the scope of the present disclosure.

The method 600 may comprise conveying 602 a straddle packer 212 within a wellbore 102 lined with a casing 112 (e.g., casing B) such that the straddle packer 212 is disposed adjacent a hole 119 extending through the casing 112 into an annular space 115 (e.g., annulus B) behind the casing 112. The straddle packer 212 may comprise a packer body 214 having a longitudinal bore 216 and a radial bore 218 connected with the longitudinal bore 216. The method 600 may further comprise setting 604 the straddle packer 212 such that a first scaling element 222 of the straddle packer 212 seals against the casing 112 above the hole 119 and a second sealing element 224 of the straddle packer 212 seals against the casing 112 below the hole 119. The method 600 may further comprise installing 606 a production tubing string 120 comprising a sensor sub 232 within the wellbore 102. The sensor sub 232 may comprise a pressure sensor 240 and a sub body 234. Installing the production tubing string 120 within the wellbore 102 may comprise conveying the production tubing string 120 within the wellbore 102 until the sub body 234 is within the longitudinal bore 216 of the packer body 214 such that the sensor 240 is in fluid communication with the annular space 115 behind the casing 112 via the hole 119 through the casing 112 and the radial bore 218 through the packer body 214. The method 600 may also comprise monitoring 608 pressure within the annular space 115 in real time via the pressure sensor 240.

The pressure sensor 240 may be connected to the sub body 234 and the sub body 234 may comprise a bore 244 extending between an outer surface of the sub body 234 and the pressure sensor 240. Installing the production tubing string 120 within the wellbore 102 may therefore comprise conveying the production tubing string 120 within the wellbore 120 until the sub body 234 is within the longitudinal bore 216 of the packer body 214 such that the bore 244 through the sub body 234 and the radial bore 218 through the packer body 214 are in fluid communication.

The method 700 may comprise conveying 702 a straddle packer 312 within a wellbore 102 lined with a casing 112. The straddle packer 312 may comprise a hole making device 314 and a packer body 214 having a longitudinal bore 216 and a radial bore 218 connected with the longitudinal bore 216. The method 700 may further comprise setting 704 the straddle packer 312 such that a first sealing element 222 of the straddle packer 312 seals against the casing 112 and a second sealing element 224 of the straddle packer 312 seals against the casing 112. The method 700 may further comprise operating 706 the hole making device 314 to cause the hole making device 314 to form a hole 119 in the casing 112 between the first sealing element 222 and the second sealing element 224. The hole 119 may extend through the casing 112 into an annular space 115 behind the casing 112. The method 700 may further comprise installing 708 a production tubing string 120 comprising a sensor sub 232 within the wellbore 102. The sensor sub 232 may therefore comprise a pressure sensor 240 and a sub body 234. Installing the production tubing string 120 within the wellbore 102 may comprise conveying the production tubing string 120 within the wellbore 102 until the sub body 234 is within the longitudinal bore 216 of the packer body 214 such that the sensor 240 is in fluid communication with the annular space 115 behind the casing 112 via the hole 119 through the casing 112 and the radial bore 218 through the packer body 214. The method 700 may also comprise monitoring 710 pressure within the annular space 115 in real time via the pressure sensor 240.

If the hole making device 314 is or comprises a pin 416 supported by the packer body 214 between the first sealing element 222 and the second sealing element 224, the method may further comprise: conveying an actuator tool 418 within the wellbore 102 until the actuator tool 418 is adjacent the hole making device 314; operating the actuator tool 418 to cause the actuator tool 418 to operate the hole making device 314 by causing the actuator tool 418 to move the pin 416 through the casing 112 to form the hole 119 in the casing 112 between the first sealing element 222 and the second sealing element 224; and retrieving the actuator tool 418 to the wellsite surface 104 from within the wellbore 102.

If the hole making device 314 is or comprises is or comprises an explosive device 514 having a projectile 516 and an explosive charge 518, the method may further comprise operating the explosive device 514 by detonating the explosive charge 518 to propel the projectile 516 toward the casing 112 to form the hole 119 in the casing 112 between the first sealing element 222 and the second sealing element 222.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions, and alterations herein without departing from the scope of the present disclosure.

The invention claimed is:

1. An apparatus comprising:

a straddle packer for use within a wellbore, wherein the straddle packer comprises:

a tubular body comprising a first bore and a second bore;

a first sealing element configured to seal against an inner surface of a casing installed within the wellbore;

a second sealing element configured to seal against the inner surface of the casing, wherein the second bore is located between the first sealing element and the second sealing element; and an obstruction disposed in association with the tubular body, wherein the obstruction is movable between a first position in which the obstruction opens the second bore and a second position in which the obstruction closes the second bore; and a sensor sub configured for connection within a downhole pipe string, wherein the sensor sub comprises:

a sensor; and a sub body carrying the sensor and configured to engage the straddle packer, wherein the sub body comprises:

a first connector configured for connection with a first portion of the downhole pipe string:

a second connector configured for connection with a second portion of the downhole pipe string;

a third bore extending between the first connector and the second connector, wherein the third bore is configured to fluidly connect the first portion of the downhole pipe string and the second portion of the downhole pipe string;

an outer surface; and a fourth bore extending between the outer surface of the sub body and the sensor.

2. The apparatus of claim 1, wherein the obstruction is or comprises a sleeve disposed in association with the tubular body, wherein the sleeve is slidable along the tubular body between the first position in which the sleeve covers the second bore and the second position in which the sleeve does not cover the second bore.

3. The apparatus of claim 1, wherein the straddle packer further comprises a biasing member operable to urge the obstruction toward the first position.

4. The apparatus of claim 1, wherein the straddle packer further comprises a fluid seal between the packer body and the obstruction to prevent or inhibit fluid communication therebetween.

5. The apparatus of claim 1, wherein the obstruction is slidably movable along the inner surface of the packer body.

6. The apparatus of claim 1, wherein, when the first sealing element and the second sealing element are sealed against the inner surface of the casing:

the obstruction prevents fluid communication between an annular space interval between the first and second sealing elements and the first bore when the obstruction is in the first position; and the obstruction permits fluid communication between the annular space interval and the first bore when the obstruction is in the second position.

7. The apparatus of claim 1 further comprising a hole making device located between the first sealing element and the second sealing element and carried by the packer body, wherein the hole making device is operable to form a hole through a wall of the casing when the straddle packer is disposed within the wellbore and the first sealing element and the second sealing element seal against the inner surface of the casing.

8. The apparatus of claim 7 wherein the hole making device comprises a pin configured to be moved by a downhole actuator through the wall of the casing to form the hole through the wall of the casing.

9. The apparatus of claim 7 wherein the hole making device is or comprises an explosive device having:

a projectile; and an explosive charge operable to detonate to propel the projectile toward the casing to form the hole through the wall of the casing.

10. The apparatus of claim 1, wherein the sub body comprises:

a smaller diameter section comprising:

the first connector;

the second connector; and the third bore;

a larger diameter section comprising:

the outer surface; and the fourth bore.

11. The apparatus of claim 1, wherein the sub body further comprises:

an upper surface;

a lower surface; and a fifth bore extending between the upper surface and the lower surface, wherein the upper surface and the lower surface are on opposing sides of the outer surface of the sub body.

12. The apparatus of claim 1, wherein the first bore is configured to accommodate the sensor sub such that:

the outer surface of the sub body is disposed against the inner surface of the packer body; and the second bore and the fourth bore are connected.

13. The apparatus of claim 1, wherein:

the sensor sub is slidably movable within the straddle packer; and when the sensor sub is slidably moved within the straddle packer, the sub body is configured to contact the obstruction and move the obstruction from the first position to the second position.

14. The apparatus of claim 13 wherein:

the sub body comprises a shoulder extending in a radially outward direction;

when the sensor sub is slidably moved within the straddle packer, the shoulder is configured to contact the obstruction and move the obstruction from the first position to the second position.

15. A method comprising:

conveying a straddle packer within a wellbore lined with a casing such that the straddle packer is disposed adjacent a hole extending through the casing into an annular space behind the casing, wherein the straddle packer comprises a packer body having a longitudinal bore and a radial bore connected with the longitudinal bore;

setting the straddle packer such that a first sealing element of the straddle packer seals against the casing above the hole and a second sealing element of the straddle packer seals against the casing below the hole;

installing a production tubing string comprising a sensor sub within the wellbore, wherein the sensor sub comprises a pressure sensor and a sub body, and wherein installing the production tubing string within the wellbore comprises conveying the production tubing string within the wellbore until the sub body is within the longitudinal bore of the packer body such that the sensor is in fluid communication with the annular space behind the casing via the hole through the casing and the radial bore through the packer body; and monitoring pressure within the annular space via the pressure sensor.

16. The method of claim 15, wherein the pressure sensor is connected to the sub body, wherein the sub body comprises a bore extending between an outer surface of the sub body and the pressure sensor, and wherein installing the production tubing string within the wellbore comprises conveying the production tubing string within the wellbore until the sub body is within the longitudinal bore of the packer body such that the bore through the sub body and the radial bore through the packer body are in fluid communication.

17. A method comprising:

conveying a straddle packer within a wellbore lined with a casing, wherein the straddle packer comprises a hole making device and a packer body having a longitudinal bore and a radial bore connected with the longitudinal bore;

setting the straddle packer such that a first sealing element of the straddle packer seals against the casing and a second sealing element of the straddle packer seals against the casing; operating the hole making device to cause the hole making device to form a hole in the casing between the first sealing element and the second sealing element, wherein the hole extends through the casing into an annular space behind the casing;

installing a production tubing string comprising a sensor sub within the wellbore, wherein the sensor sub comprises a pressure sensor and a sub body, and wherein installing the production tubing string within the wellbore comprises conveying the production tubing string within the wellbore until the sub body is within the longitudinal bore of the packer body such that the sensor is in fluid communication with the annular space behind the casing via the hole through the casing and the radial bore through the packer body; and monitoring pressure within the annular space via the pressure sensor.

18. The method of claim 17 wherein the hole making device is or comprises a pin supported by the packer body between the first sealing element and the second sealing element, and wherein the method further comprises:

conveying an actuator tool within the wellbore until the actuator tool is adjacent the hole making device;

operating the actuator tool to cause the actuator tool to operate the hole making device by causing the actuator tool to move the pin through the casing to form the hole in the casing between the first sealing element and the second sealing element; and retrieving the actuator tool to the surface from within the wellbore.

19. The method of claim 17 wherein:

the hole making device is or comprises an explosive device having:

a projectile; and an explosive charge; and the method further comprises operating the explosive device by detonating the explosive charge to propel the projectile toward the casing to form the hole in the casing between the first sealing element and the second sealing element.

20. The method of claim 17, wherein the pressure sensor is connected to the sub body, wherein the sub body comprises a bore extending between an outer surface of the sub body and the pressure sensor, and wherein installing the production tubing string within the wellbore comprises conveying the production tubing string within the wellbore until the sub body is within the longitudinal bore of the packer body such that the bore through the sub body and the radial bore through the packer body are in fluid communication.

* * * * *